United States Patent [19]

Husome et al.

[11] 4,131,540

[45] Dec. 26, 1978

[54] COLOR SORTING SYSTEM

[75] Inventors: Robert G. Husome, Jerome, Id.; Ron J. Fleming, San Jose; Ron E. Swanson, Sunnyvale, both of Calif.

[73] Assignees: Johnson Farm Machinery Co. Inc., Woodland; Acurex Corporation, Mountain View, both of Calif.

[21] Appl. No.: 793,679

[22] Filed: May 4, 1977

[51] Int. Cl.[2] ..... B07C 5/344

[52] U.S. Cl. ..... 209/582; 250/237 R; 250/226; 356/407; 356/416

[58] Field of Search ..... 209/111.6, 74 R, 111.7; 250/239, 237 R, 226; 356/178, 186

[56] References Cited

U.S. PATENT DOCUMENTS 3,939,983 2/1976 Asfour ..... 209/111.6

3,981,590 9/1976 Perkins ..... 209/111.6

*Primary Examiner*—Allen N. Knowles

*Attorney, Agent, or Firm*—Townsend and Townsend

[57] ABSTRACT

A tomato sorter is described for removing culls, e.g. green tomatoes from the good, red tomatoes. An image of each tomato passing the station is formed on a light diffusing plate. Diffused light from the plate is divided into first and second light beams from which all but the red and the green light components, respectively, are removed with filters. The remaining light is sensed by separate photo-multipliers, the output of which is used to form red and green light intensity signals. When the differential between the red and green signals exceeds a predetermined value, a reject signal is generated which actuates a mechanism for removing the affected tomato from the tomato flow.

5 Claims, 3 Drawing Figures

COLOR SORTING SYSTEM

BACKGROUND OF THE INVENTION

The handling and processing of tomatoes requires inter alia that an enormous quantity of tomatoes be individually inspected and that culls, normally spoiled and/or green tomatoes, be removed. To perform this task manually is laborious and expensive; moreover there is an inherent subjective variation in the acceptance-rejection criteria to be followed.

To overcome this problem, automatic tomato sorters have recently become available. Normally, such sorters are constructed so that they can be used in conjunction with automatic tomato harvesting equipment such as is disclosed, for example, in U.S. Pat. Nos. 3,193,020 and 3,390,768. The tomato harvester described in these patents is driven through tomato fields, removes the tomatoes from the vines and deposits them on one or more tomato collection belts. The belts transport the tomatoes to a loading conveyor which discharges the tomatoes into trucks or the like drawn alongside the harvester.

The automatic tomato sorters are positioned so that they intercept the flow of tomatoes on the collection belts, normally by arranging the tomatoes on a belt in a multiplicity of parallel rows and by individually viewing each tomato. If a tomato is determined to be a cull, e.g. if it is unacceptably green, a reject mechanism is energized which removes the tomato from the tomato flow and, normally discharges such cull onto the ground. The remaining tomatoes continue their normal course towards the discharge point.

In the past, the tomatoes were optically inspected by sensing an image of each tomato via suitable filters with a photo-sensitive device such as a photo-multiplier. The output of the photo-multipliers is supplied to a corresponding pair of matched logarithmic amplifiers the output of which is in turn sent to a summing amplifier for generating a red/green ratio signal. If the ratio signal exceeds a predetermined threshold, a reject signal is generated which energizes the reject mechanism and ejects the cull from the tomato flow.

Although such color sorters were a great improvement over the earlier manual sorting methods, the optics employed by them was sensitive and susceptible to error readings. The formation of a ratio signal requires first of all that the photo-multipliers receive light from the same point (on the tomato) and at the same time. Otherwise, the ratio signal is meaningless and the respective output signals are error signals which may lead to the rejection of a good tomato or to the acceptance of a cull.

When the image of the tomato is sensed by the photo-multipliers, great care must be taken that one of the photo-multipliers does not receive a predominant portion of its light from one part of the tomato while the other photo-multiplier receives a predominant portion of its light from another part of the tomato. Even the slightest misalignment of the components of the optics can lead to such a result. Accordingly, prior art systems of the type discussed above had to be manufactured with the utmost precision which, in turn, rendered them relatively expensive. Moreover, they required correspondingly more maintenance.

Lastly, in the rough environment of a tomato harvester, with continuous shock, vibration, dust and the like, slight optical misalignments could at times occur during use of the sorter. Any of these events can result in prolonged and expensive machine downtimes to effect the necessary repair. Since the tomato harvesting season is normally very short, a machine downtime of only a few days could seriously shorten the usefulness of the harvester for that year. In addition, if slight misalignments go undetected during harvesting operations large quantities of tomatoes, normally in the order of hundreds of tons for only a single day's production, might be rejected by processing plants due to an unacceptably high level of culls, e.g. green tomatoes in the total mass of tomatoes. In such an event, the tomatoes must be re-sorted, frequently an impossible task, or they must be discarded. In either event, the economic loss to the farmer is very large.

SUMMARY OF THE INVENTION

The present invention provides a tomato sorter which overcomes the above discussed shortcomings of prior art sorters. Although the sorter is particularly well-adapted for sorting tomatoes, its usefulness extends to any application in which large numbers of objects must be sorted according to color.

Generally speaking, the sorting system of the present invention senses diffused light of a tomato image rather than the focused image itself and has lens means for forming the image of a tomato passing an inspection station. Means is provided to diffuse the image, that is to radiate light from the image in different directions by projecting the image onto a diffuser such as a ground glass plate. In this manner, each of a plurality of photo-sensitive devices such as photo-multipliers can view the whole focused image projected onto the glass plate. The light inputs received by the photo-multipliers are synchronized and equal in intensity which is of importance in instances such as here where the image travels across the viewing surface, e.g. the ground glass plate. Aside from the simple construction and the relatively low cost of a ground glass plate diffuser, it has the important advantage that the intensity of the light received by the photo-multipliers is relatively high as compared to diffusers which seek to obliterate the image of the passing tomato and average out the light reflected by the tomato.

The diffused light radiated from the viewing surface of the ground glass is preferably divided into a plurality of light beams that are suitably filtered and directed onto the above-mentioned photo-multipliers. The signals emitted by the photo-multipliers are then processed so that a reject signal is generated when the ratio between the sensed colors reaches a predetermined threshold value. At that point, a reject mechanism is actuated to remove the cull from the product flow past the inspection station.

As already briefly discussed, the means for diffusing the light comprises a non-transparent but translucent member such as a ground or opal glass plate placed so that the lens focuses the images of passing tomatoes on the "viewing side" of the glass plate, namely the side facing the photo-multipliers. A field stop or aperture plate is placed in front of and preferably against the glass plate. The aperture diameter is selected so that the projected image of even the smallest tomato passing the inspection station has a diameter equal to or slightly greater than the aperture diameter. In this manner an incomplete illumination of the aperture by the focused image of a given tomato and the inclusion of undesirable, non-tomato fringes projected onto the glass plate are prevented. Moreover, the background, e.g. the transport belt if the tomato is inspected on the belt or a background wall if free-falling tomatoes are inspected, are painted or otherwise rendered black to prevent the pickup of colors that might adversely affect the intended reading.

To further prevent inaccurate reading and in particular a contamination of the lens of the optical system, a light tube is interposed between the lens and the tomatoes being inspected. This light tube has an elongate configuration and a sufficient length relative to its diameter, such as 6 inches or more for a 1½–2 inch diameter, to prevent fluids from tomatoes ruptured during the rejection process from reaching the lens. Such a lens contamination would not only reduce the light intensity of the diffused light spot, to the extent that the fluid is colored (e.g. green from rejected green tomatoes) it could adversely affect future readings. The provision of the light tube substantially eliminates such problems.

It is apparent that the heretofore critical alignments of the optical components are no longer necessary for obtaining an accurate color reading. Instead of sensing a focused image of the tomato the optics of the present invention senses a diffused light spot generated by the image. In this light spot, local color aberrations that may be present on a tomato as well as surface color variations as a whole are averaged out. Accordingly, no critical alignments of optical components are necessary, the overall cost of the sorter is reduced, and its reliability is substantially enhanced as compared to prior art sorters.

For installation on tomato harvesters, the sorters are normally constructed so that the tomatoes pass the sorter in a multiplicity of side by side rows. One tomato color detection system as above described is provided for each row. In addition, a multiplicity of light sources, normally incandescent lamps, are provided to illuminate the tomatoes passing the inspection station. Heretofore one light source was provided for each row.

Another aspect of the inspection provides that the light sources be of the type which emit a generally fan-shaped light beam. Such lamps are commercially available from the General Electric Corporation and they are identified as General Electric special duty lamps, bearing the stock #GE 4675. The lamps are arranged so that the fan-shaped light beam extends transversely across the tomato rows, and each light beam illuminates two or more rows. The number of light sources can therefore be less than the number of tomato rows. This reduces the overall cost of the sorter. More importantly, with such an arrangement, satisfactory operation of the sorter can be maintained even if one of the light bulbs should fail. For harvesting operations, where such failure could occur at any moment, where it can remain undetected for some time, and where it is normally difficult to immediately obtain a replacement bulb, this feature of the invention helps assure a continuous operation of the sorter without failure which could lead to an unacceptably high percentage of culls in the crop and a resulting rejection of the whole crop.

DESCRIPTION OF THE PREFERRED EMBODIMENTS

Figure 1:
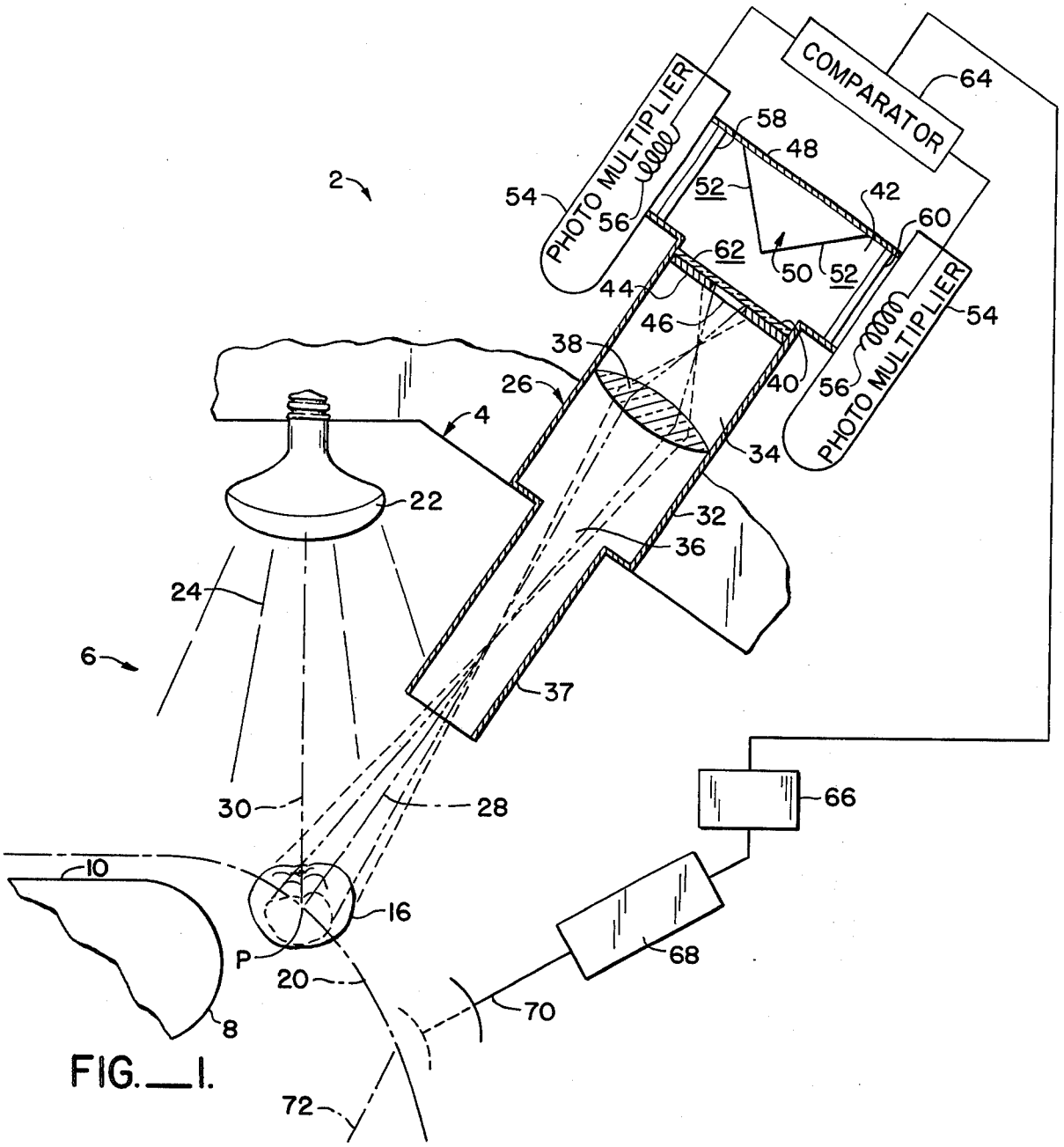
FIG. 1 is a schematic side elevational view of a tomato color sorter constructed in accordance with the present invention.
Figure 2:
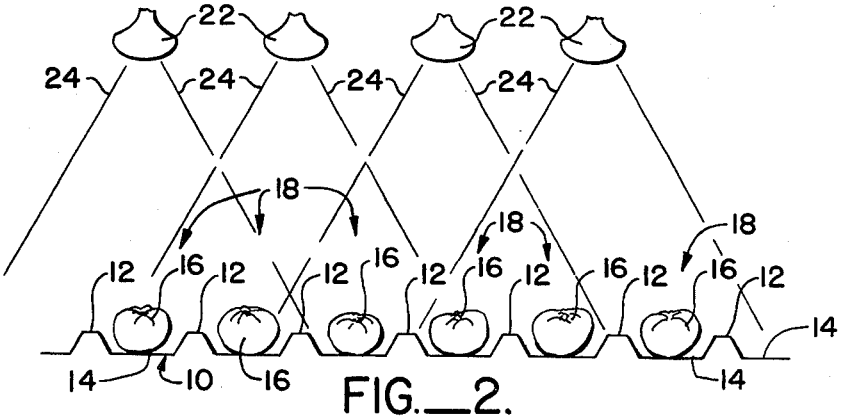
FIG. 2 is a schematic, side elevational view of the sorter illustrated in FIG. 1.

Referring to FIGS. 1 and 2, a tomato sorter 2 is schematically illustrated as being installed on a tomato harvester 4 such as the one disclosed in the above-referenced U.S. patents. The sorter defines an inspection station 6 positioned at an end 8 of a tomato transport belt 10. The belt includes a plurality of spaced apart, parallel, upwardly projecting longitudinal ribs 12 which divide the belt into a plurality of grooves 14 so that tomatoes 16 pass the inspection station in a plurality, e.g. twelve side by side tomato rows 18. At the inspection station the tomatoes are discharged from the belt and they drop downwardly along a free-fall trajectory 20 (shown in phantom lines in FIG. 1).

The inspection station is defined by a plurality of overhead light sources 22 constructed of the above referred to incandescent lamps which project fan-shaped light beams 24 as is generally shown in FIG. 2. Each light beam illuminates a plurality, e.g. three tomato rows 16 so that even in the event one of the lamps becomes inoperative, all tomato rows continue to be adequately illuminated. In addition, it will be noted that the number of light sources is less than the number of tomato rows; for example, for twelve parallel tomato rows, the provision of only six light sources is sufficient.

Also mounted to the harvester at the inspection station 6 is an optical color sensor 26 which has an optical axis 28 that intercepts the optical axis of lamps 22 and the tomato free-fall trajectory 20 at a common point P. The sensor comprises a housing 32 which has a generally T-shaped internal cavity 34 a front end 36 of which faces point P. A relatively narrow light tube 37 extends from the housing towards point P and shields the lens from splashing liquids as are frequently generated when a tomato is rejected.

A focusing lens 38 is mounted within the cavity and projects a focused image of a tomato 16 passing point P onto a back or viewing side 62 of a flat, non-transparent but translucent plate 40 mounted in the cavity between the lens and a cross-conduit 42 of the cavity. The translucent plate may be constructed of such material as ground glass, opal glass or the like.

A field stop defined by an aperture plate 44 having an aperture 46 is positioned immediately forward of glass plate 40, that is between the glass plate and the lens in close proximity to or in contact with the former. The diamater of aperture 46 is selected so that the image of even the smallest tomato expected to pass the inspection station completely fills the aperture.

Mounted to a backwall 48 of housing 26 within cavity cross-conduit 42 and in alignment with optical axis 28 is a beam splitter 50 defined by a pair of perpendicular, front surface mirror segments 52 which reflect light coming from glass plate viewing surface 62 in perpendicular directions toward first and second photo-multiplier tubes 54. The photo-multipliers are high-gain multipliers, such as are available from the RCA Corporation under RCA Part No. 7117. The photo-multiplier tubes are conventionally mounted to the housing and positioned so that their photocathodes receive light reflected by mirror surfaces 52.

Since tomato rows 18 passing the inspection station are close to each other the photo-multipliers 54 are mounted in line, that is in substantial alignment with a plane defined by the tomato trajectory 20. Each image project onto the viewing surface 62 of the ground glass plate, therefore, travels from a side of the glass plate proximate one tube to the side of the glass plate proximate the other tube. To prevent the beam spreader from directing travel across the viewing surface and before the image unequal light inputs to the tubes during the image the fills the full field of view defined by the field stop 44, the tomato image is projected on the above-discussed ground glass plate which in turn radiates light from the image in all directions, that is in a diffused manner so that each mirror 52 receives substantially identical light inputs which are, moreover, synchronized, that is which are viewed at the same instant of time. In this manner, inaccurate readings are prevented even through the tube is positioned in the trajectory plane of the tomato as contrasted with perpendicular thereto.

First and second green and red filters 58, 60 are mounted in cross-conduit 42 between the mirror segments 52 and the photo-multipliers 54 for filtering from the reflected light all but light having the desired color characteristics. For sorting tomatoes, the filters are narrow-band optical filters having a band width of between of about 5 nm to about 15 nm (preferably about 10 nm), and passing light of a wavelength of 550 and 640 nm, respectively.

In use, lamps 22 are energized so that tomatoes 16 coming off belt 10 and proceeding along trajectory 20 past inspection station 6 are fully illuminated by light beam 24. As the tomato passes point P, lens 38 focuses an image of the tomato on glass plate viewing surface 62. Aperture plate 44 limits the field of view so that even small tomatoes (as illustrated in broken lines) form an image at least as large as aperture 46. This is feasible since the minimum size of tomatoes passing the inspection station is determined by tomato sizing (not shown) included in tomato harvesters and positioned downstream of conveyor 10.

Light radiated from the illuminated viewing surface 62 of the glass plate is reflected through filters 58 and 60 to the photo-multipliers 54.

The photo-multipliers emit a color signal, the magnitude of which is a function of the intensity of light passing the filters and, therefore, the intensity of the green and red light components radiated by tomato image focused on the viewing side of the glass plate. The color signals from the photo-multipliers are supplied to a comparator 64 which compares the magnitude of the signals received from the photo-multipliers and generates a reject signal if the signal received from the "green" tube exceeds a predetermined threshold value, e.g. if it exceeds the magnitude of the signal from the "red" tube.

To avoid generating a reject signal when no tomato passes the inspection station, a red signal bias is preferably applied to the comparator 64. For example, this can be done by bleeding a relatively small, constant current into the "red input" of the comparator so that the red signal fed to the comparator exceeds the green signal at all times when no tomato image is focused on the viewing surface 62 of the ground glass plate.

The reject signal from comparator 64 is fed to a suitable reject actuator such as a solenoid valve 66 which, in turn, energizes a pneumatic actuator 68 to advance a reject piston 70 towards trajectory 20 and deflect the tomato to be rejected from the free-fall trajectory into a discard path schematically illustrated by phantom lines 72. Thereafter, the reject piston is returned to its rest position until the next reject signal is generated.

The threshold value for generating a reject signal by comparator 64 is selected to suit the particular application, field conditions, the end use of the tomatoes and the like. If desired, a variable threshold ratio selector (not shown or described) may be included.

Figure 3:
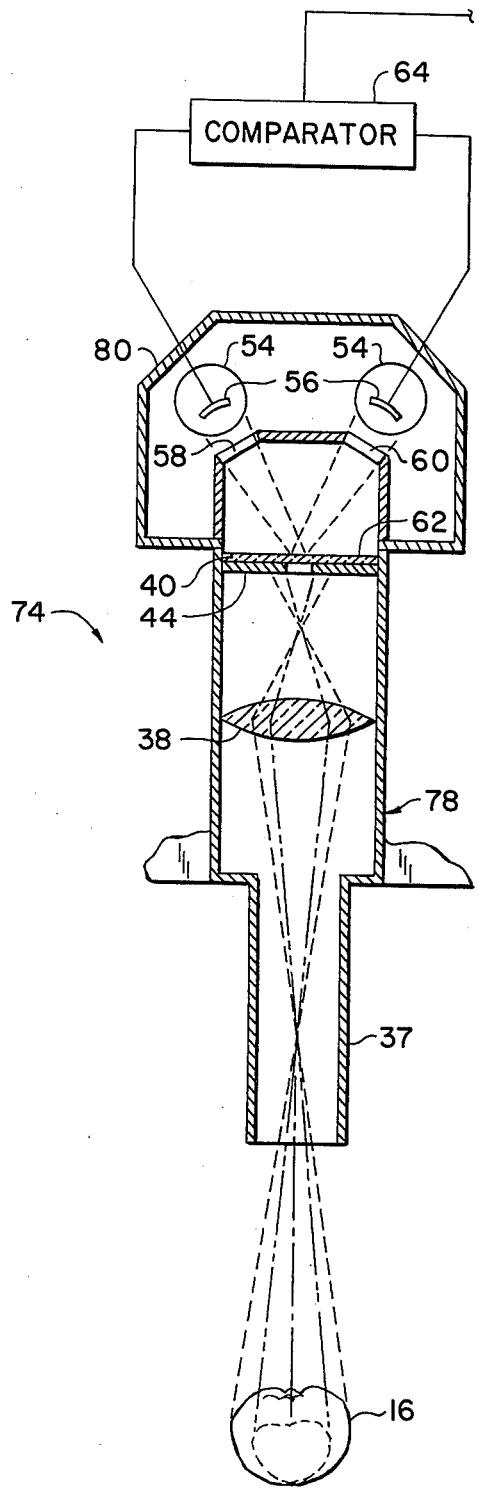
FIG. 3 is a schematic plan view of another embodiment of a tomato color sorter.

Referring now to FIG. 3, in another embodiment a color sensor 74 is constructed similar to sensor 26 shown in FIG. 1 but differs therefrom primarily in that photo-multiplier tubes 54 are arranged perpendicular to the plane in which the trajectory of tomato 16 lies; that is, the tomato falls perpendicular to the plane of the paper as viewed in FIG. 3. Sensor 74 includes a housing 78 the front end of which is fitted with a light tube 37 as above-described. A focusing lens 38 is mounted in the housing and projects an image of a tomato 16 via an aperture plate 44 to the viewing side 62 of a translucent e.g. ground glass plate 40.

Photo-multiplier tubes 54 are suitably mounted to box 80 attached to the back end of housing 78 so that their longitudinal axes are parallel to the direction of travel of the tomato. Green and red filters 58, 60 are mounted at an inclined angle between viewing surface 62 and tubes 54 so that light radiated from the viewing surface 62 by the focused image of a tomato passing the inspection station reaches photo-cathodes 56 directly, that is without the need for interposed mirrors.

As before, the output signal from the photo-multiplier tube is fed to comparator 64 which generates a reject signal as above-described to energize a pneumatic actuator 68 via a solenoid 66.

I claim:

1. Tomato sorting apparatus comprising in combination:

(a) means for serially moving tomatoes in a row past an inspection station along a predetermined path;

(b) illumination means at the inspection station for illuminating the passing tomatoes;

(c) a translucent, light diffusing plate positioned at the inspection station, and having a viewing side facing away from the tomatoes at the inspection station;

(d) a lens disposed between tomatoes passing the inspection station and the plate for forming on the viewing side of the plate a focused image of each tomato passing the station; whereby diffused light generated by image radiates away from the viewing side;

(e) field stop means defining a light aperture disposed between the lens and the plate for limiting the size of the image formed on the plate so that images of tomatoes of substantially the smallest acceptable diameter substantially fully cover the aperture;

(f) a beam splitter positioned to receive the diffused light directing diffused light beams in different directions;

(g) filter means positioned to intercept the light beams and remove from the beams all but relatively narrow green and red light bands including light of a wavelength of about 550 and about 640 nanometers, respectively;

(h) first and second photo-multipliers positioned to receive the green and red light bands for generating a green light signal and a red light signal, respectively, as a function of green light and red light, respectively, present in the image of the tomatoes projected onto the viewing side;

(i) means for forming a reject signal from the signals of the photo-multipliers when the magnitude of the green signal has a predetermined magnitude relative to the red signal;

(j) a reciprocating member positioned to contact tomatoes to be removed and responsive to the reject signal for removing such tomatoes from the tomato flow past the inspection station; and (k) an elongated light tube having a length exceeding its width disposed between the lens and tomatoes passing the inspection station for preventing fluids from tomatoes being removed by the reciprocating member from the flow from contacting the lens.

2. Apparatus according to claim 1 including means for moving the tomatoes in a plurality of parallel, side by side rows past the inspection station, and wherein the illumination means comprises a plurality of light sources positioned to illuminate the tomatoes at the inspection station, the plurality of light sources being less than the plurality of tomato rows.

3. Apparatus according to claim 3 wherein the light sources comprise incandescent lamps emitting a fan-shaped light beam, the fan-shaped light beam being positioned transversely with respect to the tomato rows so that each such light beam simultaneously illuminates a plurality of tomato rows.

4. A fruit sorting apparatus comprising in combination:

(a) means for moving the fruit in a plurality of parallel, side-by-side rows past an inspection station;

(b) illumination means at the inspection station for illuminating the passing fruit, the illumination means comprising a plurality of incandescent lamp emitting a fan-shaped light beam positioned to illuminate the fruit at the inspection station, the plurality of lamps being less than the plurality of fruit rows, the fan-shaped light beams being oriented to extend transversely with respect to the fruit rows and formed and positioned so that each such light beam simultaneously illuminates a plurality of fruit rows;

(c) means disposed at the inspection station for viewing fruit passing the inspection station and illuminated by the lamps;

(d) means operatively connected with the viewing means for analyzing the color of fruit and for generating a signal for each fruit; and (e) rejecting means responsive to the signal for removing from the rows of fruit, fruit which has a predetermined color characteristic.

5. A system according to claim 4 wherein the rejecting means comprises a reciprocating member positioned at the inspection station and operative to contact fruit to be removed; and wherein the viewing means includes an elongated light tube having a length exceeding its width, the light tube being disposed between the fruit passing the inspection station and a remainder of the viewing means for preventing fluids from fruit being removed by the reciprocating member from contaminating such remainder of the viewing means.

* * * * *